United States Patent [19]

Gillette

[11] 4,297,386

[45] Oct. 27, 1981

[54] CONTROL GRID IN ELECTROSTATIC FLUIDIZED BED COATER

[75] Inventor: Donald J. Gillette, Guilford, Conn.

[73] Assignee: Electrostatic Equipment Corporation, New Haven, Conn.

[21] Appl. No.: 114,656

[22] Filed: Jan. 23, 1980

[51] Int. Cl.[3] ..... B05D 1/06

[52] U.S. Cl. ..... 427/27; 427/32; 427/117; 427/185; 118/624

[58] Field of Search ..... 427/27, 29, 32, 185, 427/25, 117; 118/624, 625, 638, 654, 309, DIG. 5, 629

[56] References Cited

U.S. PATENT DOCUMENTS

| | | | |
|---|---|---|---|
| 3,336,903 | 8/1967 | Point | 427/27 |
| 3,593,678 | 7/1971 | Miller | 427/27 |
| 3,690,298 | 9/1972 | Venturi | 118/629 |
| 3,865,079 | 2/1975 | Kellams et al. | 118/629 |
| 3,919,437 | 11/1975 | Brown et al. | 427/32 |
| 3,979,531 | 9/1976 | Heller | 427/185 |
| 4,069,792 | 1/1978 | Nethersole | 118/309 |
| 4,073,265 | 2/1978 | Walling et al. | 118/309 |

*Primary Examiner*—John H. Newsome
*Attorney, Agent, or Firm*—Ira S. Dorman

[57] ABSTRACT

Apparatus is provided for the fluidized bed electrostatic coating of workpieces, especially those of continuous length, such as metal wires. The apparatus includes a control grid (normally grounded), which spans the coating chamber and establishes an electrical effect which densifies and regulates the cloud of charged particles therewithin. Objects (also normally grounded) passed through the cloud so produced may therefore readily develop a uniform deposit upon all exposed surfaces.

19 Claims, 4 Drawing Figures

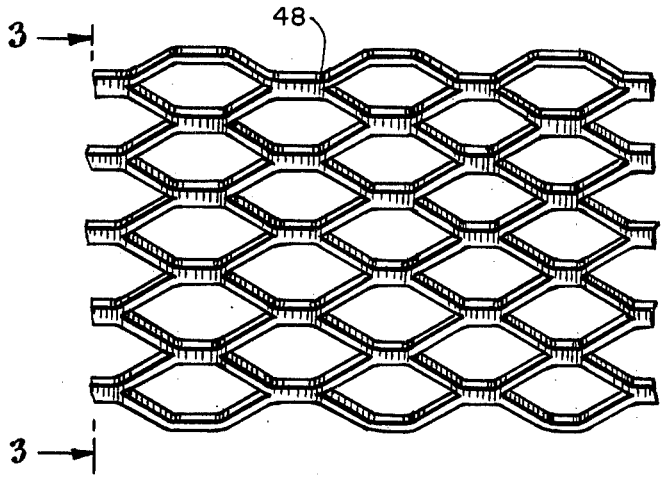
FIG. 2
FIG. 3
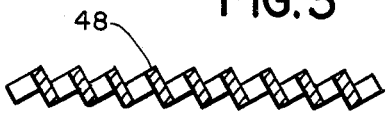
FIG. 4
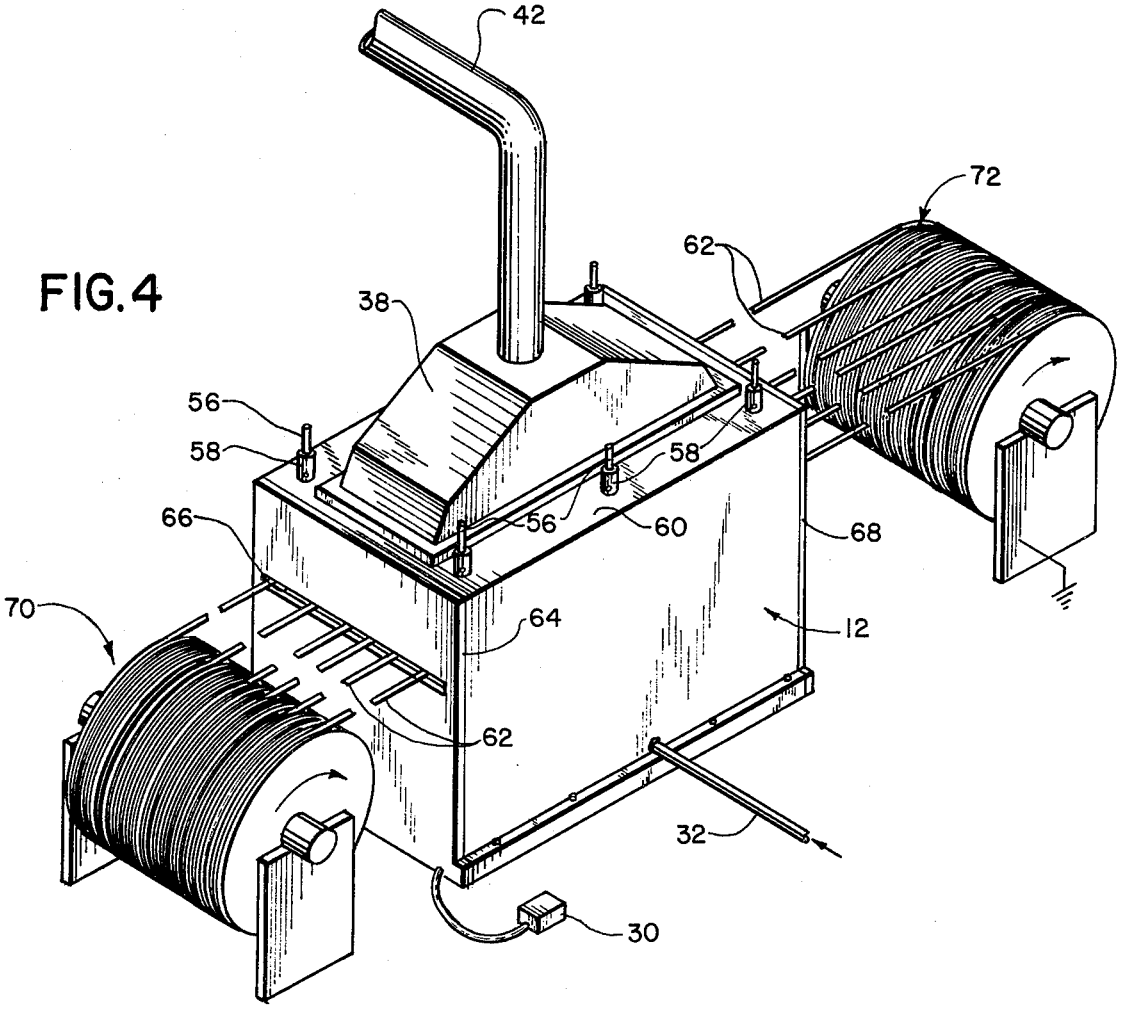

CONTROL GRID IN ELECTROSTATIC FLUIDIZED BED COATER

BACKGROUND OF THE INVENTION

Electrostatic fluidized bed coating is, of course, a conventional and widely used technique for depositing particulate materials upon a great diversity of workpieces. Typical of the apparatus used for that purpose are the devices disclosed in Knudsen U.S. Pat. No. 3,916,826 and in Karr U.S. Pat. No. 4,030,446. While electrostatic coating with such devices is highly efficient, effective and safe, fluidized bed coating in general is not without its limitations and difficulties.

A particularly difficult problem relates to the attainment of uniform deposits upon all surfaces of the articles being coated. Such problems are due in part to the effects of the workpiece configuration upon the nature of the coating produced. Thus, a non-uniform workpiece will tend to develop an irregular deposit, particularly when, for example, the article has sharp edges or elements of relatively small dimension. But even when the workpiece is of entirely uniform configuration and is free of edges (e.g., when it is a length of round wire), the proximity of other workpieces will usually have an effect. Thus, when a plurality of wires are coated simultaneously, stopping or removing one of them will usually significantly change the characteristics of the deposit produced upon the others. This is highly undesirable in an automated operation, such as is, as a practical matter, necessary in the commercial production of insulated wire.

In those instances in which coatings are produced upon articles moving horizontally (or substantially so) above or through a fluidized bed, the difficulty of producing uniformity is compounded by the fact that rarefraction occurs upwardly within the cloud. As a result, the upper surfaces of the articles are exposed to less powder than are the lower portions, and therefore the deposits developed thereon tend to be thinner. The generally upward movement of the particles of the cloud, under the influence of the gas passing upwardly through the porous support plate of the fluidized bed, also favors the development of heavier coatings on lower surfaces.

Attempts have been made to compensate for the foregoing characteristics of electrostatic fluidized bed coating, such as through the use of appropriate masking devices to block those surfaces which would otherwise tend to receive disproportionately large amounts of the powder. Similarly, in Westervelt et al U.S. Pat. No. 4,011,832, build control means is disclosed for the purpose of selectively achieving either a uniform or a nonuniform deposit upon a workpiece, the invention being directed in particular to wire coating. While that approach has considerable merit, it nevertheless involves complexity of design, and tailoring of the equipment to a specific application.

Another difficulty which is inherent in powder coating entails the need for control, so as to minimize the waste of powder and to avoid creating an unhealthy and hazardous work environment. In some instances, these objectives are accomplished by the collection and recirculation of the coating powder, such as with a system of the sort disclosed in Carlson et al U.S. Pat. No. 4,123,175. While such systems are widely used, and are very effective, their installation does entail a considerable capital investment, and requires a significant amount of floor space. Problems of powder loss and contamination have also been dealt with through the use of electrodes, which are appropriately positioned with respect to the cloud and either grounded or charged to attract or repel fugitive particles. Such an approach is taught by Nakaya in U.S. Pat. No. 3,059,613, and by Point in U.S. Pat. No. 3,336,903. While such techniques may have merit, they do not provide the degrees of control and regulation necessary for convenient and effective operation as a practical matter, and especially not for purposes of coating wire on a commercial basis.

Thus, it is a principle object of the present invention to provide a novel apparatus, system and method for producing a dense, uniform and well regulated cloud of electrostatically charged particles in a fluidized bed, in which cloud workpieces may readily be uniformly coated without need for masking or other mechanical devices.

It is also an object of the invention to provide such an apparatus, system and method, in which powder control is inherently afforded, and in which safety of operation is not compromised.

Another object is to provide the foregoing by means that are relatively simple, inexpensive and convenient.

SUMMARY OF THE DISCLOSURE

It has now been found that certain of the foregoing and related objects of the present invention are readily attained in electrostatic fluidized bed coating apparatus comprising, in combination, a housing having a generally planar, substantially horizontal porous support member mounted therein to define a fluidization chamber thereabove and a plenum therebelow. Means is provided for introducing gas into the plenum for passage upwardly through the support member to effect fluidization of particulate coating material supplied to the chamber, and additional means is provided to effect electrostatic charging of such material. The apparatus includes an electrically conductive, mesh-like control grid which is disposed within and substantially across the chamber above the support member. The grid is substantially free of horizontal flat surfaces, and is adapted for control of its electrical potential. Also, the housing is adapted for the passage of a workpiece therethrough at a location between the support member and the conductive grid. As a result, the cooperative effects of fluidization and electrostatic charging may produce a cloud of electrostatically charged particulate material above the support member, and the control grid may be used to affect the characteristics of such a cloud.

In the preferred embodiments of the apparatus, the control grid is mounted for vertical adjustment within the fluidization chamber, so as to vary its spacing from the support member. Most desirably, the grid will consist essentially of an expanded metal member, the elements of which member are twisted from the general plane of the grid, so as to dispose substantially all flat surfaces thereof at an angle thereto. Normally, the grid will be electrically grounded, and it is desirable that the grounding circuit thereof include a variable resistor, so as to enable facile adjustment of its electrical effect. In especially preferred embodiments, the housing of the apparatus is substantially closed, and the apparatus additionally includes a filtered outlet conduit communicating with the upper portion of the housing above the grid, so as to enable the withdrawal of the fluidization gas therefrom.

The apparatus of the invention is especially well suited for the coating of a multiplicity of workpieces of continuous length moving substantially horizontally therethrough, and accordingly the housing of the apparatus will generally be adapted, or will have appropriate means, to permit such movement therethrough. The apparatus is especially well-suited for the coating of metal wires, especially magnet wire, shaped conductors, and the like. For optimum operation, it will generally be desirable to provide means for vibrating the control grid, so as to thereby further reduce the tendency for any powder to collect thereon. Maximum safety in the apparatus will normally be afforded by utilizing means for ionizing gas passing from the plenum and into the fluidization chamber, to effect electrostatic charging of the coating powder.

Certain other objects of the invention are readily attained in a system for electrostatically coating a continuous length workpiece. Such a system will include, in addition to fluidized bed coating apparatus having the features hereinabove described, means for conveying the workpiece therethrough. Such a system will employ a fluidized bed having a housing which is adapted for substantially horizontal movement therethrough of at least one workpiece of continuous length, and generally it will be designed for the coating of a plurality of such workpieces, which will, in most instances, be wires.

Additional objects of the invention are readily attained in a method for depositing a particulate material upon a workpiece including, as an initial step, forming within a fluidized bed of particles an electrostatically charged cloud thereof. The density and uniformity of the cloud is increased by establishing thereabove and thereacross an electrical effect, at a potential different from that of the charged particles. A workpiece, maintained substantially at the potential of the electrical effect, is passed through the cloud at a level below that at which the electrical effect is established, so that the article may acquire, upon all of its exposed surfaces, a substantially uniform deposit of the particles. Generally, the electrical effect and the workpiece will be at ground potential. The method is especially valuable when used to simultaneously coat a multiplicity of workpieces in the cloud, and most particularly when the workpieces are metal wires.

BRIEF DESCRIPTION OF THE DRAWINGS

FIG. 2 is a plan view of an expanded metal grid suitable for use in the apparatus of the present invention;

FIG. 3 is a sectional view of the grid of FIG. 2, taken along line 3—3 thereof; and FIG. 4 is a perspective view, drawn to a diminished scale, of the coater of FIG. 1 in a system adapted for the continuous coating of a multiplicity of wire strands.

DETAILED DESCRIPTION OF THE ILLUSTRATED EMBODIMENTS

Figure 1:
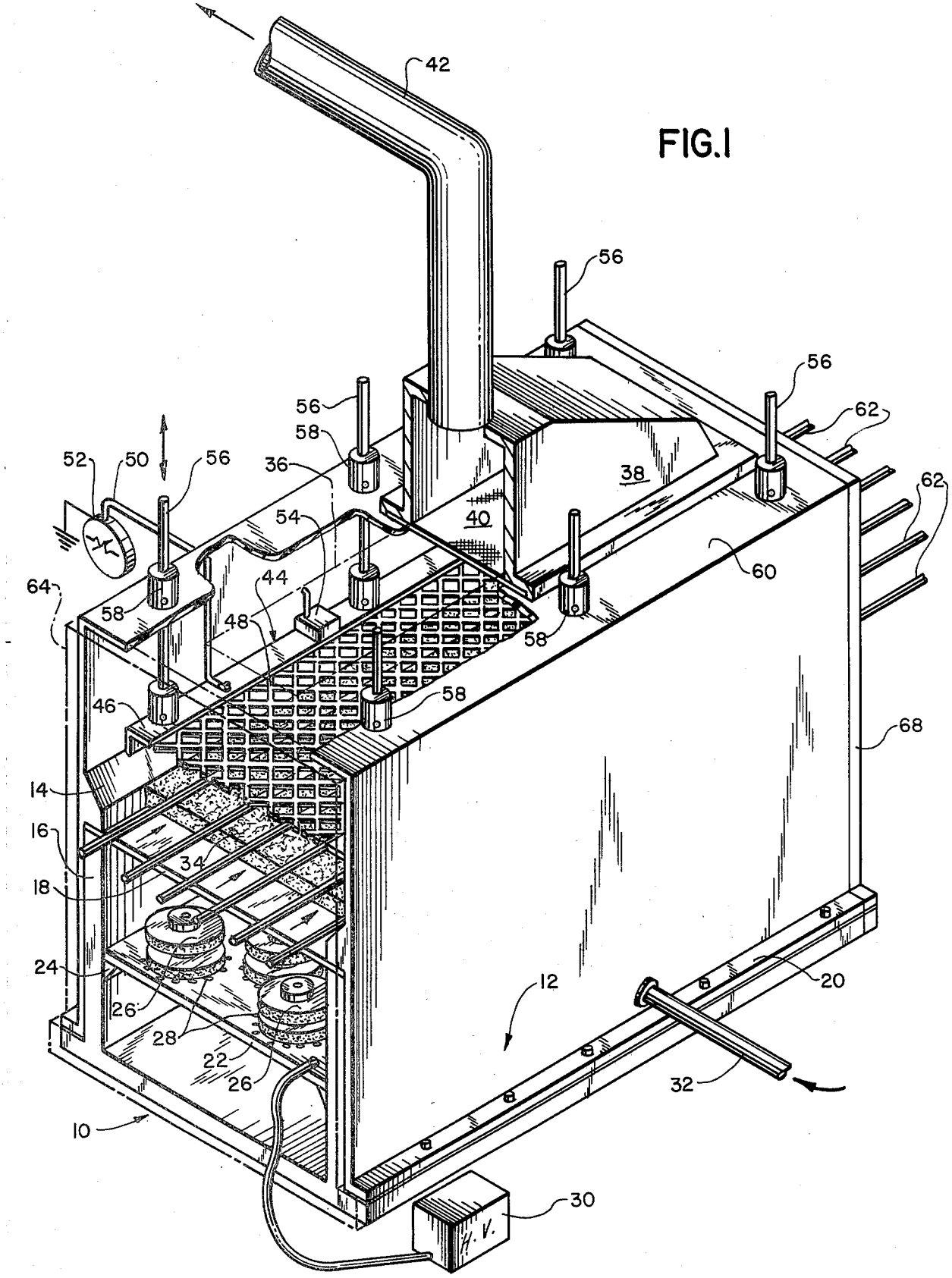
FIG. 1 is a perspective view of an electrostatic fluidized bed coater embodying the present invention, portions of the housing thereof being removed and broken away to expose the internal construction of the apparatus.

Turning now in detail to FIG. 1 of the drawings, therein illustrated is an electrostatic fluidized bed coater embodying the present invention and consisting of a bottom section and a top section, generally designated respectively by the numerals 10 and 12, which together provide the housing of the coater. As will be noted, the top section 12 is telescopically mounted upon the bottom section 10; they together support a porous support plate 18, by clamping its margins between the peripheral flange 14, on the inner wall of section 12, and the upper edge of the sidewall 16 of the bottom section 10. The sections are bolted together through the peripheral flange 20 provided about the lower edge of the top section 12.

A conductive metal base plate 22 spans the bottom section 10, and is supported upon a peripheral shoulder 24, which extends about the inner surface of the sidewall 16 at a location approximately midway of its height. The plate 22 has a multiplicity of wire brush electrode structures 26 (only three of which are visable) mounted at spaced locations over substantially its entire surface, and it has formed therethrough numerous holes 28, adapted and positioned for the passage of air from beneath the plate 22 into contact with the ends of the bristles of the electrode structures 26. High voltage is applied to the plate 22 from the source 30 thereof; the electrodes 26 are charged through electrical contact with the plate 22, to thereby ionize air passing through the pipe 32, into the portion of the plenum beneath the plate 22, and thereafter into contact with the electrodes 26. Such apparatus is more fully described in the above-identified Karr patent, the relevant disclosure of which is hereby incorporated by reference; further description need not, therefore, be provided.

As is also taught in the Karr patent, the ionized air passes upwardly from the plenum through the porous support plate 18, to thereby fluidize and electrostatically charge the powder 34, which is supported thereon. In the present apparatus, the top section 12 of the housing has a rectangular central opening 36, over which is secured a hood 38. The opening 36 is covered by a porous filter member 40, and a gas conduit 42 provides communication between the hood 38 and a vacuum source (not illustrated). Accordingly, the air passing upwardly through the porous support plate 18 is withdrawn from the coater through the filter 40 and the conduit 42.

Disposed within the fluidization chamber, which is defined within the top section 12 above the porous plate 18, is a control grid assembly, generally designated by the numeral 44. The assembly 44 consists of a frame 46 constructed of angle iron elements, within which is secured an expanded metal grid 48; the grid structure is best seen in FIGS. 2 and 3, and will be more fully discussed hereinbelow. In any event, it should be noted that the grid assembly 44 conforms substantially to the cross sectional configuration of the top section 12 of the housing; i.e., it substantially spans the fluidization chamber of the coater. The grid assembly 44 is connected to ground through cable 50 and a rheostat 52, and it has mounted thereon a vibrating device 54. Secured to the upper surface of the frame 46 are six adjustment rods 56, which pass through collars 58 affixed upon the top wall 60 of the section 12 of the housing. Set-screws are provided in the collars 58, which may be loosened to permit movement of the rods 56 therethrough, to thereby accommodate vertical adjustment of the control grid assembly 44. Six metal wires 62 are shown passing through the housing at a location between the porous plate 18 and the control grid assembly 44, and the end walls 64, 68 of the housing (the removed wall 64 being shown in FIG. 1 in phantom line) have, as seen in FIG.

4, horizontally registered elongated slots 66 formed therein, to permit passage of the wires therethrough.

As hereinabove stated, the construction of the grid 48 utilized in the assembly 44 is best shown by FIGS. 2 and 3, in which it can be seen that the grid 48 presents substantially no surface which is parallel to the general plane thereof, as is typical of expanded metal members (the "general plane" may be regarded to be that of the original metal sheet prior to its conversion to the expanded configuration). Accordingly, when the grid is disposed horizontally within the housing of the coater (as it will usually be in normal operation), virtually no horizontal surface will be presented thereby (by-and-large, the flat surfaces will be at a 45° angle to horizontal); hence, there will be very little tendency for the powder that passes through the grid 48 to collect thereupon. The vibrator 54 is provided to maintain the assembly 44 in constant agitation during operation, thereby continuously dislodging any particles of powder which may nevertheless deposit thereon (such as through electrostatic attraction), so as to further ensure that there will be no appreciable powder buildup. As will be understood, the accumulation of powder on the grid would be highly undesirable, in that clumps or agglomerates thereof, falling upon the articles during coating, would cause serious defects in the deposit.

Turning now to FIG. 4, the coating unit shown therein is that which was described in detail in connection with FIGS. 1–3, and so need not be discussed further. Diagramatically shown therein are wire supply and takeup rolls, generally designated respectively by the numerals 70 and 72. As will be apparent, the strands of wire 62 are played off from the supply roll 70, and are wound upon the takeup roll 72 (shown here to be grounded, to effect grounding of the wires), after passing through the fluidization chamber of the coater. It will also be understood that appropriate drive means and support means for the wires will be provided, although not illustrated herein. Similarly, means for heating the wire and/or the deposit, to effect fusion of the latter, means for cooling the coating subsequent to fusion, and powder feed means will also be included in a typical system. As will be appreciated, FIG. 4 is intended only to be illustrative of a wire coating system of the sort for which the fluidized bed coater disclosed herein is particularly well adapted, and should not be regarded as limiting.

As will be apparent to those skilled in the art, in operation of the system a cloud of electrostatically charged particles will be generated above the porous plate 18. During conveyance through the cloud, the grounded wires 62 will attract and hold the particles, thus producing a deposit thereupon. Because the grid 48 is also at ground potential, it will draw the charged particles to a height above that to which they would otherwise rise, thereby densifying and regulating the cloud, and producing a high degree of uniformity therein. As a result, all surfaces of the wires 62 are exposed to substantially the same concentration of powder, and therefore acquire a deposit which is uniform throughout.

The electrical effect produced by the grid upon the cloud can, of course, be altered by adjusting the rheostat 52, so as to vary the rate of charge conductance from the grid; the effect can also be altered by vertical adjustments of the assembly. In either instance, the strength of the field produced by the grid is changed, with the height and density of the cloud being affected commensurately. Because of the potential of the grid, the particles tend to be confined below it. Air, of course, passes through the grid unimpeded, and is removed from the coater under the vacuum imposed; the filter 40 serves to remove from the air stream any particles which may be entrained therein, and thereby carried through the grid.

To attain the objectives of this invention, it is important that the control grid be placed within the fluidization chamber of the coating unit; indeed, it should be positioned in rather close proximity to the workpiece and, in any event, below the level to which the charged particle cloud would normally ascend in the absence of the grid. Because of this, the grid must be of relatively dense and yet open construction, to enable the establishment of adequate field intensities without the creation of undesirable air currents, such as would tend to produce nonuniformity and thereby to defeat a primary purpose of the invention. For example, a solid plate could not be used, because of the peripheral air flow pattern that it would induce thereabout.

As noted, the control grid should substantially span the coating chamber; however, some open areas may be present for special purposes or effects. Moreover, it may be advantageous, for similar reasons, to define isolated, independently controllable regions of the grid, so as to enable different electrical effects to be established across the bed. Also, it may be desirable, in some instances, to vertically stack two or more such grids; doing so will afford, in addition to other possible advantages, the ultimate in powder control.

A particular benefit provided by the instant invention is attributable to the regulating influence that the grid has upon the cloud of particles, facilitating changes in workpiece presence during operation. Thus, it is unexpectedly found that, with the grid at the proper potential and in an appropriate position within the coating chamber, workpieces may readily be introduced, removed, or conveyed at a changed speed with very little if any effect upon the nature and quality of the deposits produced upon other objects being coated. This is of particular importance for commercial operations, in which the avoidance of a need to shut-down a system to accommodate, for example, the breakage of a wire, is of great advantage. As will be clear from the foregoing specification, the present invention is especially adapted for the coating of objects of continuous length, such as wire, strip and the like, of round or rectangular cross section. However, the concepts and practices disclosed herein are applicable to the coating of other objects, as will be apparent to those skilled in the art.

Thus, it can be seen that the present invention provides a novel apparatus, system and method for producing a dense, uniform and well-regulated cloud of electrostatically charged particles in a fluidized bed, in which cloud workpieces may readily be uniformly coated without need for masking or other mechanical devices. The invention also provides such an apparatus, system and method in which powder control is inherently afforded, and in which safety of operation is not compromised. Moreover, the foregoing is provided by means that are relatively simply, inexpensive and convenient.

Having thus described the invention, what is claimed is:

1. Electrostatic fluidized bed coating apparatus comprising, in combination: a housing having a generally planar substantially horizontal porous support member mounted therein to define within said housing a fluidization chamber thereabove and a plenum therebelow; means for introducing gas into said plenum for passage upwardly through said support member to effect fluidization of particulate coating material supplied to said chamber; means to effect electrostatic charging of such particulate material; and an electrically conductive, generally planar mesh-like control grid disposed within and substantially spanning the cross-sectional area of said chamber above said support member, said grid being substantially free of horizontal flat surfaces and being adapted for control of its electrical potential, and said housing being adapted for the passage of a workpiece therethrough at a location between and spaced from each of said support member and said grid, whereby the cooperative effects of fluidization and electrostatic charging may produce a cloud of electrostatically charged particulate material above said support member, and whereby said control grid may be used to densify and regulate such cloud, for improved coating.

2. The apparatus of claim 1 wherein said control grid is mounted for vertical adjustment within said fluidization chamber, to vary its spacing from said support member.

3. The apparatus of claim 1 wherein said grid consists essentially of an expanded metal member, the elements of which member are twisted from the general plane of said grid so as to dispose substantially all flat surfaces at an angle thereto.

4. The apparatus of claim 1 wherein said grid is electrically grounded.

5. The apparatus of claim 4 wherein the grounding circuit of said grid includes a variable resistor, so as to enable facile adjustment of the electrical potential of said grid.

6. The apparatus of claim 1 wherein said housing is substantially closed, and wherein said apparatus additionally includes a filtered outlet conduit communicating with the upper portion of said housing above said grid, for the withdrawal of gas therefrom.

7. The apparatus of claim 1 wherein said housing is adapted for substantially horizontal movement therethrough of at least one workpiece of continuous length.

8. The apparatus of claim 7 wherein said housing is adapted for passage therethrough of a multiplicity of such workpieces.

9. The apparatus of claim 8 wherein said workpieces are metal wires.

10. The apparatus of claim 1 additionally including means for vibrating said grid.

11. The apparatus of claim 1 wherein said electrostatic charging means comprises means for ionizing gas passing from said plenum into said fluidization chamber.

12. A system for electrostatically coating a continuous length workpiece, comprising:

(a) electrostatic fluidized bed coating apparatus comprising, in combination, a housing having a generally planar, substantially horizontal porous support member mounted therein to define within said housing a fluidization chamber thereabove and a plenum therebelow; means for introducing gas into said plenum for passage upwardly through said support member to effect fluidization of particulate coating material supplied to said chamber; means to effect electrostatic charging of such particulate material; and an electrically conductive, generally planar, mesh-like control grid disposed within and substantially spanning the cross-sectional area of said chamber above said support member, said grid being substantially free of horizontal flat surfaces and being adapted for control of its electrical potential, and said housing being adapted for the substantially horizontal movement therethrough of at least one workpiece of continuous length at a location between and spaced from each of said support member and said grid, whereby the cooperative effects of fluidization and electrostatic charging may produce a cloud of electrostatically charged particulate material above said support member, and whereby said control grid may be used to densify and regulate such cloud, for improved coating; and (b) means for continuously conveying said workpiece through said housing of said apparatus at said location between said support member and said grid.

13. The system of claim 12 wherein said conveying means is adapted to convey a multiplicity of such continuous length workpieces simultaneously through said housing at said location.

14. The system of claim 13 wherein said conveying means is adapted to permit the stoppage of one or more of such workpieces while permitting movement of others to continue.

15. The system of claim 13 wherein said workpieces are metal wires.

16. A method for depositing of particulate material upon a workpiece comprising the steps of: forming within a fluidized bed of particles an electrostatically charged cloud thereof; increasing the density and uniformity of said cloud with an electrically conducting grid at a potential different from that of said charged particles; and passing through said cloud, at a level below and out of contact with said grid, a workpiece maintained substantially at the potential of said grid, whereby said article may acquire upon all of its exposed surfaces a substantially uniform deposit of said particles.

17. The method of claim 16 wherein said grid and said workpiece are maintained at ground potential.

18. The method of claim 17 wherein a multiplicity of said workpieces are simultaneously coated in said cloud.

19. The method of claim 18 wherein said workpieces are metal wire.

* * * * *